United States Patent [19]

Bolte et al.

[11] 4,304,830

[45] Dec. 8, 1981

[54] TONER ADDITIVES

[75] Inventors: Steven B. Bolte, Webster; Robert J. Gruber, Pittsford; Richard F. Koehler, Jr., Webster; Edward W. Connors, Rochester, all of N.Y.

[73] Assignee: Xerox Corporation, Stamford, Conn.

[21] Appl. No.: 111,620

[22] Filed: Jan. 14, 1980

[51] Int. Cl.[3] ..... G03G 9/10

[52] U.S. Cl. ..... 430/137; 430/110; 361/226

[58] Field of Search ..... 430/107, 109, 110, 527, 430/137; 361/226

[56] References Cited

U.S. PATENT DOCUMENTS

| | | | |
|---|---|---|---|
| 3,069,428 | 12/1962 | Fitzpatrick | 430/351 |
| 3,632,617 | 1/1972 | Suzuki et al. | 430/107 |
| 3,893,935 | 7/1975 | Jadwin et al. | 430/110 |
| 3,944,493 | 3/1976 | Jadwin et al. | 430/109 |
| 3,970,571 | 7/1976 | Olson et al. | 430/137 |
| 3,985,664 | 10/1976 | Sakaguchi et al. | 430/109 |
| 4,007,293 | 2/1977 | Mincer | 430/107 |
| 4,079,014 | 3/1978 | Burness et al. | 430/110 |

FOREIGN PATENT DOCUMENTS

| | | | |
|---|---|---|---|
| 2702526 | 7/1977 | Fed. Rep. of Germany | 430/110 |
| 51-197608 | 8/1976 | Japan | 430/110 |
| 1181287 | 2/1970 | United Kingdom | 430/110 |
| 1536514 | 12/1978 | United Kingdom | 430/110 |

OTHER PUBLICATIONS

IBM Technical Disclosure Bulletin, vol. 13, #6, Nov. 1970, p. 1682.

*Primary Examiner*—Richard L. Schilling
*Assistant Examiner*—John L. Goodrow
*Attorney, Agent, or Firm*—E. O. Palazzo

[57] ABSTRACT

This invention is directed to positively charged toners comprised of a resin, a colorant, and an additive possessing an anion, and more specifically, an alkyl pyridinium compound and its corresponding hydrate, of the formulas

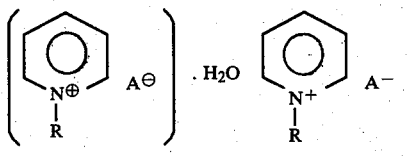

wherein A is an anion, which in a preferred embodiment is selected from halides such as fluoride, chloride, bromide, or iodide; sulfate, sulfonate, nitrate borate, and phosphate; R is a hydrocarbon radical containing from about 8 to about 22 carbon atoms and preferably from 12 to 18 carbon atoms. An important embodiment of the present invention is directed to a process for rapidly charging (or admixing) uncharged dry electrostatographic toner, containing the alkyl pyridinium compounds of the above formulas, subsequent to its addition to previously charged developer, whereby the uncharged toner particles acquire a charge within a period of from about 1 minute to about 5 minutes. The toners of this invention are useful for developing images of high quality in an electrostatographic imaging system.

5 Claims, No Drawings

TONER ADDITIVES

This invention is generally directed to new toners and the use of such toners in developers, which are useful for causing the development of images in electrophotographic systems. More specifically, the present invention is directed to toners containing additives, which additives function as charge control agents, for the purpose of providing a positive charge on the toner material, and for increasing the admix charging rate of new toner when added to a developer package.

The electrophotographic process and more specifically, the xerographic process is well known, as documented in several prior art references. In these processes, an electrostatic latent image is developed by applying electroscopic particles or toner to the electrostatic latent image, using, for example, the cascade development method as described in U.S. Pat. No. 3,618,552, magnetic brush development as described in U.S. Pat. Nos. 2,874,063 and 3,251,706, or touchdown development as described in U.S. Pat. No. 3,166,432. In some instances, it may be desirable in such systems to produce a reverse copy of the original, thus, for example, it may be desired to produce a negative copy from a positive original, or a positive copy from a negative original.

In U.S. Pat. No. 3,893,935, there is disclosed the use of certain quaternary ammonium salts as charge control agents for electrostatic toner compositions. According to the disclosure of this patent, certain quaternary ammonium salts when incorporated into toner materials were found to provide a toner composition which exhibited relatively high uniform and stable net toner charge, when mixed with a suitable carrier vehicle. U.S. Pat. No. 4,079,014 contains a similar teaching with the exception that a different charge control agent is used, namely a diazo type compound.

Many of the described developers have a tendency to lose their positive charge over a period of time and in some instances, such additives are incompatible with the thermoplastic resin, thus making it difficult to uniformly disperse or dissolve such materials in the toner. Further, when new uncharged toner is added to the developer package in order to replenish toner, the new toner being added does not acquire the desired positive charge until a substantial period of time has elapsed, and it is important in order to obtain constantly good quality images, as well as for other purposes, that the new toner being added acquires rapidly the appropriate positive charge. This is referred to as admix charging. Also the use of charge control agents as described in U.S. Pat. No. 3,893,935 are soluble in water causing them to be leached to the toner surface by moisture thereby adversely affecting the machine environment, and the copy quality.

Accordingly, there is a need for developers which can be used in a reversal system, and more specifically there is a need for positively charged toner materials, thus allowing a production of high quality images over a long period of time. Also there is a need for toners which will rapidly charge new toner being added to the developer package.

SUMMARY OF THE INVENTION

It is an object of this invention to provide a toner which overcomes the above-noted disadvantages.

It is a further object of this invention to provide a developer which contains toner and carrier, with the toner being charged positively.

Another object of this invention is the provision of a developer which contains positively charged toner having improved toner admix charging.

Another object of the present invention is the provision of toners which will develop electrostatic images containing negative charges on the photoreceptor surface, and which will transfer effectively electrostatically from such a photoreceptor to plain bond paper without causing blurring, or adversely effecting the quality of the resulting image.

An additional object of the present invention is to provide charge control materials which are completely compatible with the toner resin.

These and other objects of the present invention are accomplished by providing toners containing a resin, colorant, and an additive possessing a mobile anion, and more specifically, an alkyl pyridinium compound and its corresponding hydrate, the alkyl pyridinium compound being of the formula:

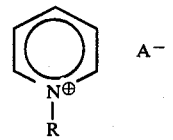

wherein A is an anion, which in a preferred embodiment is selected from halides, such as fluoride, chloride, bromide, or iodide; sulfate, sulfonate, nitrate, borate, and phosphate; R is a hydrocarbon radical containing from about 8 to about 22 carbon atoms, and preferably from 12 to 18 carbon atoms.

Illustrative examples of hydrocarbon radicals include octyl, nonyl, decyl, myristyl, cetyl, olely, pentadecyl, heptadecyl, octadecyl, and the like.

The formula of the corresponding hydrate is:

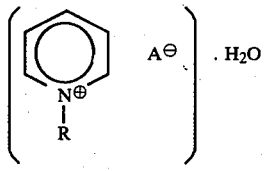

wherein R and A are as defined hereinbefore.

Illustrative examples of alkyl pyridinium compounds useful in the present invention include cetyl pyridinium chloride, heptadecyl pyridinium bromide, heptadecyl pyridinium chloride, myristyl pyridinium chloride and the like, as well as the corresponding hydrates. Other alkyl pyridinium chlorides and their hydrates not specifically listed herein may also be useful providing they do not adversely affect the system. The preferred alkyl pyridinium compound useful in the present invention is cetyl pyridinium chloride.

Toners and developers containing the alkyl pyridinium compounds of the present invention, rapidly charge new uncharged toner being added as replenishment material to the developer package. This is known as rapid admix charging. By admix charging is meant providing the appropriate charges, for example, positive charges, at a rapid rate to new uncharged toner;, replenishment toner being added to the toner which already contains charges thereon. As is customary in xerographic imaging systems new toner, must be added to the system, as toner is being consumed for the development of images. In the past the new uncharged toner being added, did not obtain appropriate charge until a significant period of time has elapsed, for example after 10 to 15 minutes. This adversely effected the developer package and thus good high quality images, would not result until the new uncharged toner had acquired electrical charges. In some instances no images whatsoever could be developed until the uncharged toner was mixed with the charged toner in the machine system being used, which usually involved 10 to 15 minutes mixing time.

When the alkyl pyridinium compound is present in the toner the rate at which the uncharged toner acquries charge, such as positive charge, is substantially less than 10 minutes. Typically, the uncharged toner becomes suitably charged within from about 1 minute to about 5 minutes, and preferably less than 3 minutes. Such rapid admix charging allows the developer system to become more stable over a shorter period of time, as compared to prior art systems, therefore, better quality images are obtained with no background. This was a significant finding that was not appreciated by the prior art.

The alkyl pyridinium compounds can be used in any amount that does not adversely affect the system, and that results in a toner that is charged positively in comparison to the carrier, and further that allows rapid admix charging of any new toner added to the developer package. Thus, for example, the amount of alkyl pyridinium compound present ranges from about 0.1 weight percent, to about 10 weight percent, preferably from about 0.5 weight percent to about 5 weight percent, of the total weight. In one preferred embodiment the alkyl pyridinium compound is present in an amount from from 0.75 weight percent to 3.0 weight percent. The alkyl pyridinium compound can be blended into the system or coated on a pigment, such as carbon black, which is used as a colorant in the developing composition.

Numerous methods may be employed to produce the toner of the present invention, one method involving melt blending the resin and the pigment coated with the alkyl pyridinium compound, followed by mechanical attrition. Other methods include those well known in the art such as spray drying, melt dispersion, and dispersion polymerization. For example, a solvent dispersion of a resin pigment and alkyl pyridinium compound are spray dryed under controlled conditions, thereby resulting in the desired product. Such a toner prepared in this manner results in a positively charged toner in relationship to the carrier materials used, and these materials exhibit the improved properties such as rapid admix charging as mentioned herein.

While any suitable resin may be employed in the system of the present invention, typical of such resins are polyamides, epoxies, polyurethanes, vinyl resins and polyester especially those prepared from dicarboxylic acids and diols comprising diphenols. Any suitable vinyl resin may be employed in the toners of the present system, including homopolymers or copolymers of two or more vinyl monomers. Typical of such vinyl monomeric units include: styrene, p-chlorostyrene, vinyl naphthalene, ethylenically unsaturated mono-olefins such as ethylene, propylene, butylene, isobutylene and and like; vinyl halides such as vinyl chloride, vinyl bromide, vinyl fluoride, vinyl esters such as vinyl acetate, vinyl propionate, vinyl benzoate, vinyl butyrate and the like; esters of aliphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

Generally toner resins containing a relatively high percentage of styrene are preferred. The styrene resin employed may be a homopolymer of styrene or styrene homologs of copolymers of styrene with other monomeric groups. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic, and cationic polymerization processes. Any of these vinyl resins may be blended with one or more resins if desired, preferably other vinyl resins, which insure good triboelectric properties and uniform resistance against physical degradation. However, non-vinyl type thermoplastic resins may also be employed including resin modified phenolformaldehyde resins, oil modified epoxy resins, polyurethane resins, cellulosic resins, polyether resins, and mixtures thereof.

Also esterification products of a dicarboxylic acid, and a diol comprising a diphenol may be used as a preferred resin material for the toner composition of the present invention. These materials are illustrated in U.S. Pat. No. 3,655,374 totally incorporated herein by reference, the diphenol reactant being of the formula as shown in column 4, beginning at line 5 of this patent, and the dicarboxylic acid being of the formula as shown in column 6 of the above patent. The resin is present in an amount so that the total of all ingredients used in the toner total about 100%, thus when 5% by weight of the alkyl pyridinium compound is used, and 10% by weight of pigment or colorant such as carbon black, about 85% by weight of resin material is used.

Optimum electrophotographic resins are achieved with styrene butylmethacrylate copolymers, styrene vinyl toluene copolymers, styrene acrylate copolymers, polyester resins, predominantly styrene or polystyrene base resins as generally described in U.S. Pat. No. Re. 25,136 to Carlson, polystyrene blends as described in U.S. Pat. No. 2,788,288 to Rheinfrank and Jones, and styrene-butadiene resins.

Any suitable pigment or dye may be employed as the colorant for the toner particles, such materials being well known and including for example, carbon black, nigrosine dye, aniline blue, calco oil blue, chrome yellow, ultramarine blue, DuPont oil red, methylene blue chloride, phthalocyanine blue and mixtures thereof. The pigment or dye should be present in the toner in sufficient quantity to render it highly colored, so that it will form a clearly visible image on the recording member. For example, where conventional xerographic copies of documents are desired, the toner may comprise a black pigment, such as carbon black, or a black dye such as Amaplast black dye available from the National Aniline Products, Inc. Preferably, the pigment is employed in amounts from about 3% to about 20% by weight based on the total weight of toner, however, if the colorant employed is a dye, substantially smaller quantities may be used.

Any suitable carrier material can be employed, as long as such carrier particles are capable of triboelectrically obtaining a charge of opposite polarity to that of the toner particles. In the present invention in one embodiment that would be a negative polarity, so that the toner particles will adhere to and surround the carrier particles. Thus, the carriers can be selected so that the toner particles acquire a charge of a positive polarity, and include materials such as sodium chloride, ammonium chloride, ammonium potassium chloride, Rochelle salt, sodium nitrate, aluminum nitrate, potassium chlorate, granular zircon, granular silicon, methylmethacrylate, glass, steel, nickel, iron ferrites, silicon dioxide and the like, with metallic carriers especially magnetic carriers being preferred. The carriers can be used with or without a coating. The coatings generally contain polyvinyl fluoride resins, but other resins especially those which charge negatively, such as polystyrene, halogen containing ethylenes and the like can be used. Many of the typical carriers that can be used are described in U.S. Pat. Nos. 2,618,441; 2,638,522; 3,618,522; 3,591,503, 3,533,835; and 3,526,533. Also nickel berry carriers as described in U.S. Pat. Nos. 3,847,604 and 3,767,598 can be employed, these carriers being modular carrier beads of nickel characterized by surface of reoccurring recesses and protrusions providing particles with a relatively large external area. The diameter of the coated carrier particle is from about 50 to about 1000 microns, thus allowing the carrier to possess sufficient density and inertia to avoid adherence to the electrostatic images during the development process.

The carrier may be employed with the toner composition in any suitable combination, however, best results are obtained when about 1 part per toner is used, to about 10 to about 200 parts by weight of carrier.

Toner compositions of the present invention may be used to develop electrostatic latent images on any suitable electrostatic surface capable of retaining charge including conventional photoconductors, however, the toners of the present invention are best utilized in systems wherein a negative charge resides on the photoreceptor, and this usually occurs with organic photoreceptors, illustrative examples of such photoreceptors being polyvinyl carbazole, 4-dimethylaminobenzylidene, benzhydrazide; 2-benzylidene-amino-carbazole, 4-dimethylamino-benzylidene, benzhydrazide; 2-benzylidene-aminocarbazole, polyvinyl carbazole; (2-nitrobenzylidene)-p-bromoaniline; 2,4-diphenyl-quinazoline; 1,2,4-triazine; 1,5-diphenyl-3-methyl pyrazoline 2-(4'-dimethyl-amino phenyl)-benzoxazole; 3-aminocarbazole; polyvinylcarbazole-trinitrofluorenone charge transfer complex; phthalocyanines and mixtures thereof.

The following examples are being supplied to further define the species of the present invention, it being noted that these examples are intended to illustrate and not limit the scope of the present invention. Parts and percentages are by weight unless otherwise indicated.

EXAMPLE I

A toner comprising 90 parts by weight of 58/42, (58 percent styrene 42 percent n-butylmethacrylate), copolymer of styrene and n-butyl methacrylate was prepared by melt blending this resin with 10 parts by weight of carbon black, commercially available from Cabot Cororation (Raven 5750) and micronized to 12 microns volume average size. The toner was then dispersed in a solution of cetyl pyridinium chloride in methanol. Subsequently the resulting product was dried, yielding 2 percent by weight of cetyl pyridinium chloride on the toner. Two parts by weight of this toner was mixed and roll milled for 1 hour with 100 parts by weight of a carrier consisting of a 100 micron ferrite core, coated with 1.2 percent by weight of a fluorinated copolymer commercially available from Firestone Company (FPC-461).

A developer consisting of the cetyl pyridinium chloride containing the above toner, (B), had a charge to mass ratio of +21 $\mu$C/gram (microcolumbs per gram) compared to +13 $\mu$C/gram for control developer, (A), without cetyl pyridinium chloride. The charging rate (admix rate) of the toner was measured by placing 80 grams of the above developers, containing toner (A) and toner (B) in a small magnetic brush fixture. An aluminum plate is moved through the region of the magnetic brush, with the surface speeds of the magnetic brush and the plate fixed at a ratio of 4:1. Subsequently the aluminum plate is developed at several bias potentials, selected to suppress development, and the percent area coverage of background toner on the plate was measured, by an automatic particle analyzing system. Both well mixed developers (A) and (B) had an area coverage of less than 1.5 percent. A good developer when it is well mixed results in an area coverage (background) of less than 1.5 percent. By area coverage is meant the amount of area covered by black as compared to the amount of the entire area of the plate.

The toner concentrations were then incremented by 1 percent while the magnetic brush is agitated. For the developer containing the cetyl pyridinium chloride treated toner the area coverage increases but remains at less than 5 percent, and recovers to the initial value, less than 1.5 percent within 5 minutes of mixing. The background from the developer containing the untreated toner increases to values above 20 percent area coverage, and does not recover to the initial coverage value in less than 15 minutes of mixing. Thus, the rate at which the toner charge is obtained when uncharged toner is added to the developer is increased by the cetyl pyridinium chloride charge inducing agent. The magnitude of the triboelectric charge is also increased.

It was observed that uncharged toner containing cetyl pyridinium chloride, rapidly obtained positive charge within 2 minutes, as compared to greater than 15 minutes for uncharged toner which did contain cetyl pyridinium chloride, after it was added to the charged developer package in a xerographic machine. Excellent copies of high quality, and substantially no background were obtained immediately after the new uncharged toner containing cetyl pyridinium chloride was added to the system. Such copies were produced in a xerographic fixture, employing the well known xerographic imaging steps as detailed for example in U.S. Pat. Nos. 3,618,552 and 3,251,706, the disclosure of these patents being fully incorporated herein by reference.

EXAMPLE II

A toner comprising 90 parts by weight of a polyester resin, (a propoxylated bisphenol fumarate copolymer resin, as described in U.S. Pat. No. 3,590,000) was melt blended with 10 parts by weight of carbon black (Black Pearls L) and micronized to 12 microns volume average size. One portion of the toner was treated with 2 percent by toner weight of cetyl pyridinium chloride as in Example I. Both treated (D) and untreated (C) toners are roll mill mixed with the carrier of Example I for 1 hour yielding chargetomass ratios, Q/M, of +8 μC/gram and +3 μC/gram respectively. In a similar experiment to Example I the developer containing the treated toner recovered to the initial background level within 1 minute while the untreated toner required greater than 15 minutes.

It was observed that uncharged toner containing cetyl pyridinium chloride rapidly obtained positive charge within 2 minutes, as compared to greater than 15 minutes for uncharged toner which did not contain cetyl pyridinium chloride, after it was added to the charged developer package in a xerographic machine. Excellent copies of high quality, and substantially no background were obtained immediately after the new uncharged toner containing cetyl pyridinium chloride, was added to the system. Such copies were produced in a xerographic fixture, employing the well known xerographic imaging steps as detailed for example in U.S. Pat. Nos. 3,618,552 and 3,251,706.

EXAMPLE III

A toner comprised of 94 parts of a 65/35 copolymer styrene nbutyl methacrylate resin, was blended with 6 parts carbon black (Regal 330). A portion of the toner was treated with 2 percent cetyl pyridinium chloride as in Example I. When mixed with the carrier of Example I the charge-to-mass ratios of the treated (F) and untreated (E) toners were +34 μC/gram and +31 μC/gram respectively. In an experiment similar to Example I the background recovered within 1 minute with the treated toner while the untreated toner required greater than 15 minutes of mixing.

EXAMPLE IV

A toner (G) comprised of 92 parts of the styrene n-butyl methacrylate resin of Example III, 6 parts of the carbon black of Example III (Regal 330) and 2 parts of cetyl pyridinium chloride was formed by melt blending of the three components, and subsequent micronization. The developer had a charge-to-mass ratio of +44 μC/gram with the carrier of Example I. In development simulations the background recovers with less than 3 minutes of mixing.

It was observed that uncharged toner containing cetyl pyridinium chloride, rapidly obtained positive charge within 3 minutes after it was added to the charged developer package in a xerographic machine. Excellent copies of high quality, and substantially no background were obtained immediately after the new uncharged toner was added to the system. Such copies were produced in a xerographic fixture, enploying the well known xerographic imaging steps as detailed for example in U.S. Pat. Nos. 3,618,552 and 3,251,706.

EXAMPLE V

A carrier was made by coating 1 percent by weight of a high molecular weight polystyrene (Styron 666U) onto the carrier core of Example I. The treated (F) and untreated (E) toners of Example III gave charge-to-mass ratios of +18 μC/gram and +5 μC/gram respectively when mixed with this carrier. In the development simulation the background recovered within 2–3 minutes with the treated toner and required greater than 15 minutes with the untreated toner.

It was observed that uncharged toner containing cetyl pyridinium chloride, rapidly obtained positive charge within 2–3 minutes, as compared to greater than 15 minutes for uncharged toner which did not contain cetyl pyridinium chloride, after it was added to the charged developer package in a xerographic machine. Excellent copies of high quality, and substantially no background were obtained immediately after the new uncharged toner was added to the system. Such copies were produced in a xerographic fixture, employing the well known xerographic imaging steps as detailed for example in U.S. Pat. Nos. 3,618,552 and 3,251,706.

EXAMPLE VI

The toner of Example IV, toner (G) was mixed with the carrier of Example V to give a triboelectric charge-to-mass ratio of +19 μC/gram. The background recovered with 3–4 minutes.

EXAMPLE VII

An irregular iron grit powder (Hoeganaes Sponge Iron 80/150) was incompletely coated with the fluorinated copolymer of Example I. The treated (F) and untreated (E) toners of Example III when mixed with this carrier produced charge-to-mass ratios of +30 μC/gram and +8 μC/gram respectively. The developer containing the treated toner recovered the original background level within 1 minute of mixing, whereas the developer containing the untreated toner required greater than 15 minutes of mixing.

The above Examples establish that the use of cetyl pyridinium chloride increases the rate at which new uncharged toner gains charge from an already toned developer. Further, the addition of cetyl pyridinium chloride increases the magnitude of the triboelectric charge.

The results are summarized in the following Tables:

| Toner | Composition | Charge Control Agent |
|---|---|---|
| A | 90/10*, Copolymer Styrene/n-butyl methacrylate resin 58/42 | None |
| B | 90/10*, Copolymer Styrene/n-butyl methacrylate resin 58/42 | 2% cetyl pyridinium chloride, surface coated onto attrited toner |
| C | 90/10**, Copolymer Propoxylated bisphenol Fumarate resin | None |
| D | 90/10**, Copolymer Propoxylated bisphenol Fumarate resin | 2% cetyl pyridinium chloride, surface coated onto attrited toner |
| E | 94/6***, Copolymer Styrene/n-butyl methacrylate resin 65/35 | None |
| F | 94/6***, Copolymer Styrene/n-butyl methacrylate resin 65/35 | 2% cetyl pyridinium chloride, surface coated onto attrited toner |
| G | 92/6/2 Copolymer, styrene/n-butyl meth- | Cetyl pyridinium chloride, melt blended with resin and carbon |

-continued

| Toner | Composition | Charge Control Agent |
|---|---|---|
| | acrylate resin 65/35 | black |

*90 percent resin, 10 percent pigment, Raven Black 5750
**90 percent resin, 10 percent pigment, Carbon Black, Black Pearls L
***94 percent resin, 6 percent pigment, Carbon Black Regal 330
G - 92 percent resin, 6 percent Carbon Black Regal 330, and 2 percent cetyl pyridinium chloride

| Carrier | Core (Diameter) | Coating |
|---|---|---|
| I | 100 μm (microns) ferrite | 1.2% Fluorinated Copolymer, FPC-461 |
| II | 100 μm (microns) ferrite | 1% Polystyrene, Styron 666U |
| III | 80/150 Hoeganaes Sponge Iron | 0.8%, Fluorinated Copolymers, FPC-461 |

| Developer (Toner/Carrier) | Charge-To-Mass Ratio (μc/gm Microcolumbs per gram) | Admix Rate (minutes) |
|---|---|---|
| A/I | 13 | >15 |
| B/I | 21 | 2-3 |
| C/I | 3 | >15 |
| D/I | 8 | 1 |
| E/I | 31 | >15 |
| F/I | 34 | 1 |
| G/I | 44 | 3 |
| E/II | 5 | >15 |
| F/II | 18 | 2-3 |
| G/II | 19 | 3-4 |
| E/III | 8 | >15 |
| F/III | 30 | 1 |
| G/III | 33 | 1 |

>greater than

EXAMPLE VIII

Toner A' was prepared comprising 6 percent Regal 330 carbon black commercially available from Cobot Corporation, 2 percent of cetyl pyridinium chloride commercially available from Hexcel Company and 92 percent of styrene/n-butyl methacrylate (65/35) copolymer resin (XP 252 resin) by melt blending followed by mechanical attrition. Three parts per weight of this toner and 100 parts per weight of 0.35 percent perfluoroalkoxy fluoropolymer commercially available from DuPont company coated on a Hoeganaes steel carrier were placed in a glass jar and roll mixed at a linear speed of 90 feet per minute for the time indicated in the following Table. The triboelectric charge of the toner was measured by blowing off the toner from the carrier in a Faraday cage.

| Roll Mixing Time | Toner Tribo μc/g (microcoloumbs per gram) |
|---|---|
| 5 min. | +38 |
| 10 min. | +38 |
| 1 hr. | +34 |
| 24 hr. | +33 |

The toner was fast charging against the carrier and the tribo was stable in the long mixing period.

The carbon black dispersion and particle-to-particle uniformity of this toner was examined by a transmission electron microscope technique and from this examination excellent quality was shown in both categories.

Toner A' was classified to remove particles having average diameters below 5 microns. Three parts of the classified toner and 100 parts of 0.4 percent of perfluoroalkoxy fluorinated polymer coated Hoeganaes steel carrier are blended into a developer. The developer is tested in a fixture using a photoreceptor charged negatively and good quality print with high optical density and low background were obtained.

EXAMPLE VIII (A)

Three parts of the classified Toner A' and 100 parts of 0.2% Kynar 201, vinylidene fluoride resin available from Pennwalt Corporation, coated atomized steel carrier were blended into a deveoper. The developer was separately aged at low (about 20%) relative humidity and at high (about 80%) relative humidity for 24 hours. Tribo measurements showed there was no significant difference in triboelectric charge between the developers at low relative humidity and at high relative humidity, indicating the humidity insensitivity of the developer materials. The developer is tested in a fixture using a photoreceptor charged negatively and good quality prints were obtained.

EXAMPLE IX

Toner B' comprising 6 percent Regal 330 carbon black, 1.5 percent cetyl pyridinium chloride, and 92.5 percent styrene n-butyl methacrylate 65/35 copolymer was prepared by melt blending followed by mechanical attrition. The toner was classified to remove particles having diameters below 5 microns. Three parts of classified Toner B' and 100 parts of 1.6 percent of FPC 461 a fluorocarbon polymer commercially available from Firestone Polymer Company coated Hoeganaes steel carrier were blended into a developer. The developer is tested in a fixture using a photoreceptor charged negatively. Prints of excellent quality and low background are obtained.

EXAMPLE X

Toner C' comprising 6 percent of cetyl pyridinium chloride treated Regal 330 carbon black, 1 percent of cetyl pyridinium chloride and 93 percent styrene/n-butyl methacrylate 65/35 copolymer resin was prepared by melt blending followed by mechanical attrition. Three parts of this toner and 100 parts of 0.35 perfluoroalkoxy fluoropolymer commercially available from DuPont Company coated Hoeganaes steel carrier were placed in a glass jar and roll milled at a linear speed of 90 feet per minute. The triboelectric charges of this toner as a function of mixing time were as follows:

| Roll Mixing Time | Tribo uc/gram (Microcoulombs per gram) |
|---|---|
| 5 min. | +37 |
| 10 min. | +38 |
| 1 hr. | +37 |
| 24 hr. | +40 |

The toner was fast charging against the carrier and the tribo was stable. Transmission electron microscopic work showed the Toner C' had excellent carbon black dispersion and particle-to-particle uniformity.

EXAMPLE XI

Toner D' comprising 10% Regal 330 carbon black, 3% cetyl pyridinium chlorde, and 87% styrene/n-butyl methacrylate (65/35) copolymer resin was prepared by melt blending followed by mechanical attrition. The toner was classified to remove particles having diameters below 5 microns. Three parts of classified toner D' and 100 parts of 0.4% Kynar 201 vinylidene fluoride resin coated atomized steel carrier are blended into a developer. The developer is tested in a fixture using a photoreceptor charged negatively and prints of excellent quality were produced.

EXAMPLE XII

Toner E' comprising 25% Mapico Black magnetite available from Cities Service Co., 3% cetyl pyridinium chloride, and 72% styrene/n-butyl methacrylate (65/35) copolymer resin is prepared by melt blending followed by mechanical attrition. The toner was classified to remove particles having diameters below 5 microns. Three parts of classified Toner E' and 100 parts of 0.2 percent Kynar 20 vinylidene fluoride resin coated atomized steel carrier were blended into a developer. The developer is tested in a fixture using a photoreceptor charged negatively. Prints of good quality and low background are obtained.

EXAMPLE XIII

Toner E' comprising 25% Mapico black magnetite available from Cities Service Co., 3% cetyl pyridinium chloride, and 72% styrene/n-butyl methacrylate (65/35) copolymer resin is prepared by melt blending followed by mechanical attrition. The toner was classified to remove particles having diameters below 5 microns. Three parts of classified toner E' and 100 parts of 0.2 percent Kynar 20 vinylidene fluoride resin coated atomized steel carrier were blended into a developer. The developer is tested in a fixture using a photoreceptor charged negatively. Prints of good quality and low background are obtained.

Other modifications of the present invention will occur to those skilled in the art based upon a reading of the present disclosure. These are intended to be included within the scope of this invention.

What is claimed is:

1. A process for rapidly charging to a positive polarity uncharged toner particles being added to a charged developer composition comprised of a mixture of resin, pigment, and carrier particles, which comprises adding to the charged developer composition uncharged toner particles comprised of resin particles and pigment particles, and containing from about 0.1 to 10 percent based on the weight of said toner particles an alkyl pyridinium compound or its hydrate of the formula

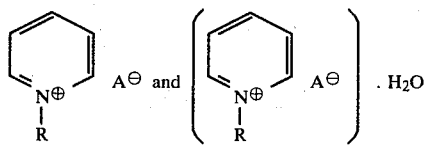

wherein R is a hydrocarbon radical containing from about 8 to about 22 carbon atoms, and A is an anion, wherein positive charges migrate from the charged developer composition to the uncharged toner particles within a period of from about 1 minute to about 5 minutes.

2. A process in accordance with claim 1 wherein the uncharged toner particles acquire a positive charge within a period of from about 2 minutes to about 4 minutes.

3. A process in accordance with claim 1 wherein the resin is a styrene n-butylmethacrylate copolymer, the pigment is carbon black, the carrier is comprised of a ferrite core coated with a fluorocarbon polymer, and the alkyl pyridinium compound is cetyl pyridinium chloride.

4. A process in accordance with claim 1 wherein the anion is a halide.

5. A process in accordance with claim 1 wherein the uncharged toner particles acquire a charge of from about 21 microcoulombs per gram to about 40 microcoulombs per gram, in a period of from about 2 minutes to about 4 minutes, and the anion is chloride.

* * * * *

UNITED STATES PATENT AND TRADEMARK OFFICE

CERTIFICATE OF CORRECTION

PATENT NO. : 4,304,830

DATED : December 8, 1981

INVENTOR(S) : Steven B. Bolte, et al.

It is certified that error appears in the above–identified patent and that said Letters Patent are hereby corrected as shown below:

Col. 1, line 20, please change 3,618,552 to 2,618,552.

Signed and Sealed this

*Nineteenth* Day of *April 1983*

[SEAL]

*Attest:*

GERALD J. MOSSINGHOFF

*Attesting Officer*

*Commissioner of Patents and Trademarks*